United States Patent [19]

Tokunaga et al.

[11] Patent Number: 4,504,326

[45] Date of Patent: Mar. 12, 1985

[54] METHOD FOR THE PRODUCTION OF COLD ROLLED STEEL SHEET HAVING SUPER DEEP DRAWABILITY

[75] Inventors: Yoshikuni Tokunaga; Masato Yamada, both of Tokai, Japan

[73] Assignee: Nippon Steel Corporation, Tokyo, Japan

[21] Appl. No.: 539,678

[22] Filed: Oct. 6, 1983

[30] Foreign Application Priority Data

| | | | |
|---|---|---|---|
| Oct. 8, 1982 | [JP] | Japan | 57-176340 |
| Apr. 14, 1983 | [JP] | Japan | 58-64604 |
| Apr. 23, 1983 | [JP] | Japan | 58-71939 |

[51] Int. Cl.[3] ..... C21D 8/04

[52] U.S. Cl. ..... 148/12 C; 148/12.3; 148/36

[58] Field of Search ..... 148/12.3, 12.4, 12 C, 148/12 D, 12 F, 36; 75/123 M, 123 J

[56] References Cited

U.S. PATENT DOCUMENTS

| | | | |
|---|---|---|---|
| 3,765,874 | 10/1973 | Elias et al. | 148/12 C |
| 3,897,280 | 7/1975 | Gordo et al. | 148/12 C |

FOREIGN PATENT DOCUMENTS

| | | | |
|---|---|---|---|
| 41354 | 12/1981 | European Pat. Off. | 148/12 C |
| 97431 | 7/1980 | Japan | 148/12 F |
| 131167 | 10/1980 | Japan | 148/12 D |
| 62926 | 5/1981 | Japan | 148/36 |
| 84422 | 7/1981 | Japan | 148/12 F |
| 142826 | 11/1981 | Japan | 148/12 F |
| 166331 | 12/1981 | Japan | 148/12 C |
| 104627 | 6/1982 | Japan | 148/12 C |

*Primary Examiner*—Peter K. Skiff

*Attorney, Agent, or Firm*—Wenderoth, Lind & Ponack

[57] ABSTRACT

Method for the production of a cold rolled steel sheet which has a distinguished deep drawability as well as chemical treating ability by the steps of providing a very low carbon steel, adding Ti and Nb in combination to said steel, hot rolling and cold rolling said steel to produce a cold rolled steel sheet, and subjecting said cold rolled steel sheet to a continuous anneal at a temperature of more than 700° C. to less than the $Ac_3$ transformation point.

13 Claims, 9 Drawing Figures

METHOD FOR THE PRODUCTION OF COLD ROLLED STEEL SHEET HAVING SUPER DEEP DRAWABILITY

BACKGROUND OF THE INVENTION

1. The present invention relates to a method for producing a steel sheet having super deep drawability, more particularly, to a method for producing a cold rolled steel sheet having excellent secondary workability as well as good chemical treatability.

2. Description of Prior Art

There are two general categories of steel sheet having super deep drawability: Ti killed steel sheet such as that described in U.S. Pat. No. 3,522,110, and Nb killed steel sheet such as that described in U.S. Pat. No. 3,761,324 or 3,876,390.

In this connection, as it has become easily possible to reduce the C content of Nb killed steel to the level of C<50 ppm, there have been recent reports in the literature of the feasibility of producing Nb killed steel sheet with low C and Nb contents. On the presumption that the steel sheet is to have a very low C content, Ti or Nb, both of which have a strong tendency to form carbide and nitride, is added to obtain a steel sheet containing almost no interstitial elements such as C or N. There is thus the advantage that a steel sheet product of about the same quality can be obtained using either continuous or box annealing. In the case where the steel sheet is produced using the continuous anneal, however, there is encountered certain disadvantages as discussed in the following.

In the case of Ti killed steel, there is the disadvantage that secondary work cracking tends to occur. In particular, when, with the aim of obtaining a high quality steel, Ti is added to the steel at more than an equivalent amount with respect to C or N, an increase in the P content will increase risk of the secondary work cracking. Further, there is a disadvantage that addition of P will degrade the r value.

In addition, in the production of a steel sheet coated with alloyed zinc by means of the Sendzimir continuous molten zinc coating process, which constitutes one type of continuous annealing, the alloying proceeds so excessively that the coating is easily peeled off (this phenomenon is termed, "powdering" hereinafter) when the sheet is subjected to press forming work. On the other hand, there is the advantage that a steel sheet of stable quality can be produced using continuous anneal even at an ordinary coiling temperature of 600°-650° C.

In contrast, in the case of Nb killed steel, it is necessary to coil the hot rolled strip at a high temperature (coiling temperature ≧700° C.). This is because when coiling is carried out at an ordinary coiling temperature, the complete recrystallization temperature becomes so very high that a semi-recrystallized portion remains when annealing is carried out within the temperature range feasible with a continuous annealing oven (not more than about 850° C.) and, moreover, because in such case the quality varies greatly with the amount of Nb. It has frequently been reported that when coiling is carried out at a high temperature, it is possible to obtain a steel sheet having a high r value in all but the end portions of the hot rolled strip at an annealing temperature of about 800°-850° C. In the high temperature coiling, however, the formed scale becomes so thick as to impair the pickling efficiency. Moreover, as the rate of cooling at the coil ends is high, it becomes impossible to obtain a product of sufficient quality. For these reasons, there is a pronounced decline in product yield.

A very low carbon steel sheet with added Ti and Nb is disclosed in U.S. Pat. No. 3,765,874. The amount of Nb is more than 0.025%, and the steel sheet containing more than 0.025% Nb as a solid solution is disclosed in this patent.

The inventors have investigated the steel of the above composition in detail, and found that this steel sheet has the following defects.

As the recrystallization temperature is considerably high, a good quality cannot be obtained by the usual anneal temperature. Further, in the rapid heating and short time annealing, such as continuous anneal, and in the feasible annealing temperature (usually, less than 850° C.), a satisfactory recrystallization will not take place, or the grain growth after recrystallization never occurs.

Since the amount of Nb added is too much: (1) Carbide thus precipitated is fine, so the migration of the grain boundary is greatly hindered by the precipitate; (2) the growth of recrystallized grains is considerably restricted by the solution drag effect due to the high amount of solid solution Nb. In other words, since the amount of Nb is too much, as described hereinbefore, it has the same defect as that of the Nb killed steel.

As a steel stock for the continuous anneal, a good r value and El cannot be obtained by low temperature coiling, and the stock is hard; the deterioration of quality of the coil end portion is still remarkable even by the high temperature coiling. Furthermore, as the steel contains to much of both Ti and Nb its chemical treatability is inferior.

SUMMARY OF THE INVENTION

It is a prime object of the present invention to provide a method for producing a cold rolled steel sheet having excellent ductility as well as deep drawability by adding Ti and Nb in combination to a very low carbon steel.

It is another object of the invention to provide a method for producing an excellent cold rolled steel sheet having a uniform mechanical property in the longitudinal direction of the coil and exceedingly small anisotropy of the r value by adding Ti and Nb in combination to a very low carbon steel.

It is still an additional object of the invention to provide a cold rolled steel sheet having outstanding chemical treatability by adding Ti and Nb in combination to a very low carbon steel.

BRIEF DESCRIPTION OF THE DRAWINGS

Other and further objects of the invention will become apparent to those skilled in the art from the following detailed description of the invention with reference to the drawings, in which.

DETAILED DESCRIPTION OF THE INVENTION

Figure 1:
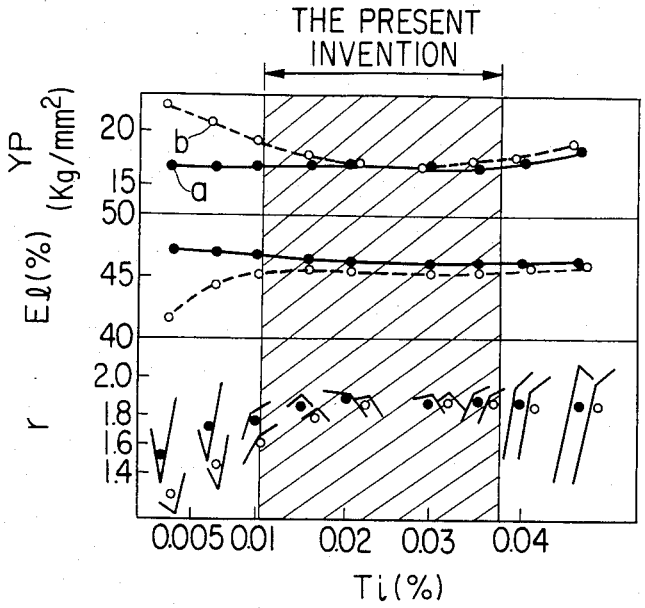
FIG. 1 is a graphic view explaining the effect of Ti content on the characteristics of a steel with both Ti and added thereto.

The inventors conducted extensive and detailed research on the merits and demerits of Ti killed and Nb killed steels. Their conclusions regarding the behaviors of these steels are outlined in the following. Sine Ti is a very powerful nitride forming element, TiN is found to be already formed in the heating furnace before hot rolling. Although the precipitation temperature of carbides is lower than that of nitrides, it is thought that a considerable portion of the carbides precipitate and a nitride becomes a nucleation site while the steel strip is being coiled at a temperature of 600°-650° C. Accordingly, a considerable part of the precipitation takes place even at a low coiling temperature so that coarse precipitates are present in the hot coil. Therefore only little precipitation takes place during continuous annealing after the cold rolling. Thus, it is considered that the recrystallization temperature will not become exceptionally high and that the product quality will be fairly uniform.

Because of this almost complete precipitation of C and N, the grain boundary becomes clean and this promotes the segregation of such impurity elements as P. As a result, the grain boundary is embrittled and secondary work cracking occurs.

In addition, in the production of a Ti killed steel sheet coated with alloyed zinc, it is thought that the powdering phenomenon tends to occur because the alloying reaction between the iron base and molten zinc is promoted to the extent that over-alloying occurs.

On the contrary, however, Nb is considerably inferior to Ti in its ability to form nitride. As a matter of fact, in a steel with added Nb, although Nb forms carbide, N precipitates as AlN. AlN is hardly formed in low temperature coiling and it is not formed in the hot rolled steel sheet unless the coiling temperature is raised to more than 700° C.; and it precipitates in a fine form during continuous annealing after the cold rolling, which results in quality deterioration owing to increased yield strength and degraded elongation property and r value. Accordingly, even if coiling is carried out at a high temperature, the quality of the end portions of the hot rolled steel becomes no better than that obtained with low temperature coiling because the cooling rate of these portions is high.

Besides, it is considered that the deterioration of quality in the leading and trailing end portions of the hot rolled coil and the fluctuation of quality throughout the coil result from the difference in the degree of forming AlN at the center and end portions of the coil and also from slight fluctuations in the coiling temperature of the hot rolled strip. However, as Nb has less carbonitride forming power than Ti, several ppm of carbon is so segregated in the grain boundary that the bond energy at the grain boundary is much increased with the result that there is no fear of secondary work cracking in spite of the considerably high content of P. Further, in the production of an alloyed zinc coated steel sheet, since Nb does not promote the alloying reaction between the iron base and the molten zinc as much as Ti, powdering is less apt to occur in an Nb killed steel than in a Ti killed steel.

Based on the above findings, the inventors proceeded to develop a method for the production of a super deep drawable steel sheet which has good homogeneous quality throughout the coil, is free from the risk of secondary work cracking, and, in the production of an alloyed zinc coated steel sheet is free from powdering. The fundamental principle employed in this invention to realize such a steel sheet is to cause N to precipitate in the steel sheet not as AlN but as TiN by the action of Ti before the finish hot rolling step, and to cause C to precipitate as a combined carbide such as (Ti·Nb)C.

As fully described hereinafter, the steel of this invention is superior to Ti killed steel in that the r value is not degraded when the high strength of the steel is increased by the addition of P, and in that almost no secondary work cracking takes place. Further, the steel of this invention is also advantageous in that almost no powdering occurs in the production of an alloyed zinc coated steel sheet.

In accordance with this invention, differently from the case of Nb killed steel, N is fixed as TiN, not as AlN, whereby nearly the same product quality can be obtained using low temperature coiling as that obtained by carrying out high temperature coiling, and whereby the steel of this invention is made superior to any steel of the prior art in respect of its exceedingly homogeneous quality in both the longitudinal and width directions of the steel coil. These advantages of the steel according to this invention provide various excellent properties not possessed by either Ti or Nb killed steel. The invention thus has great merit.

In addition, the steel of the invention to which Ti and Nb are added in combination has a unique property not inferable from either Ti or Nb killed steel of the prior art, namely it has very small anisotropy of the r value. In general, the r value of Ti or Nb killed steel is the worst in the rolling direction (L direction) or in the direction at 45° thereto while it is best in the direction at 90° to the rolling direction (C direction). However, the r value of the steel of the invention is almost the same in the L, C and 45° directions, or it is somewhat large in the 45° direction, and this property of the steel is maintained regardless of the amount of cold rolling reduction.

Never before has there been known a high r value steel sheet with such anisotropy property. The steel thus is not only very interesting from the scientific aspect but also has considerable advantages from the commercial point of view. Particularly, it can be expected to exhibit outstandingly good formability in the case of drawing a square cylindrical body (with 45° corners). The steel can be expected to be advantageously applied even to the deep drawing of circular cylinders, a process in which the rupture limit is frequently determined by the least r value. Furthermore, minimum anisotropy is very advantageous in, for instance, the drawing of the outer cylindrical case of a dry cell where the uniformity of the sheet thickness after deep drawing is critical, and in other uses where the formation of ears must be avoided as much as possible. Accordingly, the steel sheet of the present invention can be expected to attract wide interest not merely from the point of the average of the r values in three direction but from the point of its extremely low anisotropy.

The steel of this invention is superior in every respect to steels with added Ti or Nb only and constitutes an entirely new and novel steel having a totally unexpected property.

The chemical composition of the steel according to this invention will now be defined in weight %.

As mentioned above the amount of Ti to be added depends on the amount of N. AlN, as described hereinbefore, is one of the causes of deterioration in the quality of the end portions of a coil which is coiled at high temperatures, and the quality of the entirety of a coil which is coiled at low temperatures. Therefore, from the viewpoint of quality, the amount of N which is precipitated as AlN is required to be limited to at most 20 ppm. From this respect, the lower limit of the content of Ti should be 48/14 (N %-0.002%), as follows:

$$Ti > \frac{48}{14}[N\ \% - 0.002\%\ (20\ ppm)]$$

If Ti is added in more than the equivalent amount of C+N, the effect resembles that of the Ti killed steel mentioned hereinbefore; namely, the second workability is deteriorated, and the values of El and r are deteriorated when P is added. In addition, when the alloyed zinc coated steel sheet is produced, there arises a distinct defect that powdering tends to occur. Therefore, it would not satisfy the object of the present invention. Accordingly, Ti should be added less than the equivalent amount of C+N. Hence it follows:

$$Ti\ \% < (48/12C\ \% + 48/14N\ \%)$$

From the economical viewpoint, the increase of the amount of Ti is not preferred, and the most desirable amount of Ti is less than the equivalent of N, namely, Ti %≦48/14N %.

On the other hand, the amount of Nb depends on C. More specifically, Nb should be added at the rate of 0.3 times as much as the amount of C in terms of atomic ratio, as follows:

$$Nb\ \% > 0.3 \times 93/12C\ \% = 2.33C\ \%$$

Moreover, Nb should be added in an amount of not less than 0.003% to less than 0.025%. In the range of Nb %/C %<2.33 and Nb<0.003%, a combined carbide (Ti·Nb)C is not formed and a solid solution C remains, and this gives rise to the problem that a non-ageing steel is not obtained. In the range of Nb=0.025%, the properties of the steel resemble those of the Nb killed steel, its recrystallization temperature increases, and quality deterioration in the leading and trailing end portions of the coil also increases. Such a steel departs from the principle of the present invention.

Figure 2:
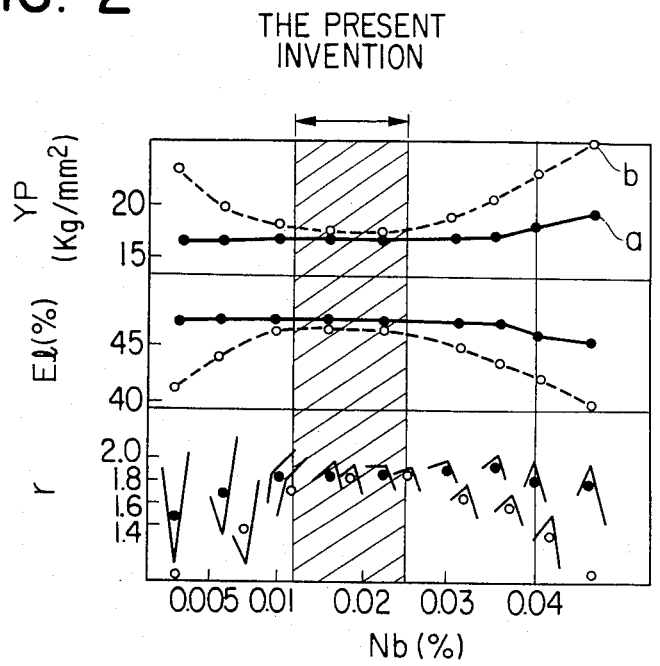
FIG. 2 is a graphic view explaining the effect of Nb content on the characteristics of a steel with both Ti and Nb added thereto.

FIGS. 1 and 2 show the range of the steel of this invention in terms of the amount of Ti and Nb.

FIG. 1 is a graph showing how the properties of the steel change when the amount of Nb is fixed(at 0.022%) and the amount of Ti is varied. The sample steel contained 0.005% C, 0.01% Si, 0.25% Mn, 0.02% P, 0.01% S, 0.06% sol.Al and 0.005% N and was coiled at 720° C. in the hot rolling step. In FIG. 1, "a" refers to the center of the coil in the longitudinal direction and "b" to the leading and trailing end portion of the coil.

In case the amount of Ti is insufficient relative to the fixed amount of N, namely, 48/14(N %−0.002%)>Ti, the quality deterioration of the leading and trailing end portions of the steel coil is particularly great. Besides, the anisotropy of the r value resembles that of a very low carbon steel with a very small amount of added Nb, and the effect of adding Ti and Nb in combination is small.

On the contrary, however, in case Ti is added in more than an equivalent amount relative to C and N, it is seen that the deterioration of quality in the leading and trailing end portions of the coil is considerably small while, on the other hand, the anisotropy of the r value is similar to that of Ti killed steel. In other words, it is only when 0.010–0.037% Ti is added that the effect of improving the texture of the steel sheet due to the addtion of TI and Nb in combination appears, and it is only within this range that there is obtained an excellent r value with a very small anisotropy.

In order to attain the excellent isotropy of the r value, the additon of Ti and Nb in combination is absolutely indispensible. This property is due to the texture of the steel which cannot be obtained by the addition of either Ti or Nb only.

FIG. 2 is a graph showing how the properties of the steel change when a certain amount (0.02%) of Ti sufficient to fix N is added while the amount of Nb added is varied. The chemical composition of the sample steel was nearly the same as that of FIG. 1. Similarly to what was seen in connection with FIG. 1, when the amount of Nb is low (less than 0.011%) relative to the amount of C, the characteristics are similar to those of a very low carbon steel, namely the r value in the 45° direction is very low while the anisotropy is high. Also similar to the case of FIG. 1, the deteriortion of quality in the leading and trailing end portions of the coil is large, and the non-ageing property is not obtained. If the amount of Nb exceeds 0.025%, the anisotropy of the r value assumes the same tendency, but there appears a disadvantage that the r value in the C direction decreases, and the deterioration of quality in the leading and trailing end portions of the coil is very great. These disadvantages are similar to those peculiar to Nb killed steel.

As clearly shown in FIG. 2, addition of Ti and Nb together makes the anisotropy of the r value small and, further, makes it possible to realize uniform quality of the coil in its longitudinal direction. These characteristics cannot be attained by the addition of either Ti and Nb only to the steel, indicating that the addition of Ti and Nb in combination is indispensable.

The reason why a high quality can be more stably obtained independently of the coiling temperature than in the case of the addition of Nb only, and further, the reason why a high quality can be obtained by the addition of a smaller amount of an alloying element than in the case of the addition of Ti only, is presumed to be explained as follows: when the steel contains Ti and Nb together in a well-balanced ratio in accordance with the method of the present invention, a combined precipitate (Ti·Nb)C is formed, and this precipitate has a high start temperature of precipitation as compared with TiC and NbC, with the result that coarse precipitates are formed. Thus, it is presumed that a favorable recrystallization behavior is observed despite the low coiling temperature and this appears to be the reason for the isotropic r value obtained. On the contrary, however, in a steel with only Nb added or Nb≧0.025%, it is NbC which forms, and the precipitation condition greatly varies with the coiling temperature. In case of a low temperature coiling, the steel quality is greatly deteriorated because fine NbC precipitates raise the recrystallization temperature at the time of continuous annealing. Besides, in the addition of Ti only, the steel quality is also greatly deteriorated unless the atomic ratio of Ti to C+N is more than 1. It appears that the steel becomes hard and the ductility is deteriorated because TiC is not fully precipitated in the hot rolled steel sheet, but is finely precipitated at the time of the continuous annealing unless the amount of Ti is much increased.

As fully described in the foregoing, in accordance with this invention a steel having excellent ductility as well as excellent deep drawability can be obtained by the addition of Nb and Ti in combination, particularly, by the addition of 0.003–0.025% Nb.

As described above, the composition range of the steel of the invention is such that: the amount of Ti to be added depends on the content of N of the steel, and Ti should be contained in a sufficient amount so as to satisfy the following relation:

$$Ti\ \% > 48/14(N\ \% - 0.002\%)$$

and $$Ti\ \% < (48/12C\ \% + 48/14N\ \%)$$

The amount of Nb to be added depends on the carbon content of the steel, and Nb should be also contained in a sufficient amount to satisfy the following relation:

$$Nb\ \% > 0.3 \times 93/12C = 2.33C\ \%$$

and $$0.003\% \leqq Nb\ \% < 0.025\%$$

The total amount of Nb and Ti should, however, be subject to the following limitation from the point of the steel's chemical treatability.

The chemical treatability of a steel sheet (how well it is adapted to phosphating) depends on the steel surface condition. In the case of an outer panel sheet of an automobile, for example, the sheet may be formed, assembled and locally machined with a grinder so that its interior is exposed. In such case, the steel sheet itself should have good chemical treatability. However, a very low carbon steel with added Ti and/or Nb is so deficient in chemical treatability that the phosphate film fails to form locally.

The inventors have found that it is necessary for forming a uniform coating of phosphate film over the steel sheet to restrict the amount of Ti plus Nb to less than 0.04%.

The reason for this restriction is that a tenacious oxide film tends to easily form on the surface of the steel sheet with an increase of the amount of Ti and Nb; tenacious oxide film is hardly reduced, and has a low reactivity with the acid. Furthermore, the matrix of the steel sheet is so purified that the reaction with Bonderite solution is deteriorated. By carrying out the production process under the above condition, the phosphate treating ability is satisfactory; particularly, when treated in accordance with $$0.01\% < Ti(\%) + Nb(\%) < 0.04\%$$

the most excellent result is obtained.

In case the amount of Ti and Nb to be added is exceedingly small (the whole amount is less than 0.01%), the amount of precipitate (carbide and nitride) to be formed is little, hence the location where there is any difference of surface energy on the surface of the steel sheet, namely, the location where the reaction with the Bonderite solution is active, is decreased.

The chemical components of the sheet other than Ti and Nb are: less than 0.007% C, less than 0.8% Si, less than 1.0% Mn, less than 0.1% P, 0.01–0.1% Al, less than 80 ppm N, Fe and unavoidable impurities.

If the C content is too high, much Nb is required to fix C and the amount of (Ti·Nb)C increases so much that it prevents the growth of recrystallized grains, which results in deterioration of the r value, a rise in yield strength, and a decrease in elongation property. Therefore C should be less than 0.007% from the viewpoint of producing a super deep drawable steel sheet.

In the production of a molten zinc coated steel sheet, Si has a tendency to lower the adherence of the coating layer, so it is preferred to be less than 0.8%. Particularly, in case the alloying treatment is not carried out, Si is preferred to be less than 0.3%.

If much Mn is added, the r value is very much deteriorated. Hence, the upper limit for Mn is set at 1.0%, from the viewpoint of obtaining a high r value.

In the steel of this invention, almost no secondary work cracking takes place due to the addition of Ti and Nb together. But if the steel contains much P, the amount of P segregated on the grain boundary increases so much that the grain boundary is embrittled to promote secondary work cracking. Hence the upper limit of P is 0.1%.

In order to suppress the secondary work embrittlement, it is effective to add B, and the amount of B to be added is preferred to be less than 30 ppm. In addition, the inventors have found that the ageing property is not deteriorated, but bake hardenability is enhanced by adding a very little amount of B. In the steel with added Nb only, B combines with N to precipitate BN, hence it is required to add B in an amount of more than the equivalent relative to N in order to attain the effectiveness of B so that the amount of B to be added is inevitably increased. Besides, in the steel with added Ti only, the purification of the steel is considerably powerful, so it is not effective to add very little B; while B forms no BN, much B is inevitably required. Therefore in the steel with either Nb or Ti only added, the secondary work embrittlement can be controlled by adding more than several 10 ppm B.

On the other hand, B in the steel, whether it may form BN or solid solution B, considerably tends to deteriorate the yield strength (YS), ductility (El), and deep drawability (r value), or also tends to increase the recrystallization temperature. Therefore the amount of B to be added is preferred to be as little as possible. Since the present invention is directed to fix N with a very small amount of Ti, the addition of a very small amount of B (less than 30 ppm) is effective to attain the effect already mentioned. Accordingly, as compared with the steel of the prior art, the steel of the invention has distinguished good properties (YP, El and r value), low recrystallization temperature, eminent secondary workability, and enhanced effect of bake hardenability. With no bad effect on mechanical quality and ageing, the addition of B in an amount of 2 ppm to 10 ppm is preferred so as to attain even more excellent secondary workability and enhancement of bake hardenability.

Al is added to the molten steel as a deoxidizer prior to the addition of Ti and Nb. If the amount of Al is too small, the deoxidizing action is not fully carried out and instead, Ti and Nb act as deoxidizers, in which case the reduction in the yield of Ti and Nb becomes pronounced. Conversely, if too much Al is added, the amount of $Al_2O_3$ inclusion increases undesirably. Based on the above reason, Al should be in the range of 0.01–0.1%.

N is fixed in the form of TiN by Ti, but if N is too much, the required amount of Ti increases undesirably. Therefore N should be less than 80 ppm.

Now, the conditions for the production of the steel sheet are described. In this invention, the usual hot rolling condition will do. With reference to the influence of the coiling temperature, owing to the reason already mentioned, as compared with the steel with added Nb only, a good quality can be obtained by the usual coiling temperature. Particularly, in order to attain uniform quality throughout the whole length of the coil, the low temperature finish and low temperature coiling are extremely effective. In accordance with the invention, as already mentioned, with the addition of Ti and Nb together, TiN precipitates in the heating furnace for hot rolling, and further, such a composite precipitate as (Ti·Nb)C precipitates sparsely at the time of finish hot rolling, hence an excellent quality can be obtained even at a rather low temperature of coiling. However, in order to form the above-mentioned precipitates at the finish hot rolling in a full and satisfactory manner, it is effective for the finish temperature to select a low temperature less than the $Ar_3$ point, in other words, the finish temperature is preferred to be in the range of 720° C. to 870° C. If the finish temperature is lower than 720° C., the Goss orientation is so developed to reduce the r value. If the coiling temperature is also more than 680° C., the grains in the hot rolled strip become coarse to reduce the r value. The uniform quality throughout the whole length of the coil is made extremely excellent by the low temperature finish hot rolling. As compared with the steel hot rolled by the high temperature finish hot rolling, the steel of the invention has a merit, such as, a relatively high r value even with a low rate, 60–75% of cold rolling.

If the above low temperature finish hot rolling process includes the limitation of the heating temperature of a steel slab, a much stabler and better quality of the steel can be obtained. The range of slab heating temperature is 950° C. to 1170° C. In this range of temperature, a nucleus of precipitate (Ti·Nb)C already forms in the heating furnace, hence it is effective. At a heating temperature of more than 1170° C., the precipitation of (Ti·Nb)C delays and it becomes so fine that the steel sheet is hardened; hence its ductility is deteriorated, and at a heating temperature of less than 950° C., the desired results of the steel at the above finish temperature are hardly obtained.

As regards the descale treatment and cold rolling condition, it is not particularly required to specify them definitely However, from the viewpoint of attaining a high r value, a rate of cold rolling of more than 60% is desirable. With reference to the recrystallization anneal, in view of secondary workability, productivity, and uniform quality in the longtudinal direction of the coil, it is not a box anneal, but an anneal process of the continuous type which is specified, wherein rapid heating, short time annealing, and quick cooling are possible. This process is preferred in order to control the diffusion of such an element as P and the like which embrittles the grain boundary in connection with the secondary workability. The anneal temperature should be adopted in the range of more than the recrystallization temperature (more than 700° C.) to less than the $Ac_3$ point. The cooling cycle after the anneal is not particularly specified, but the usual continuous annealing cycle will do.

Examples of the present invention will be described hereinbelow.

EXAMPLE 1

Table 1 shows the chemical composition of the steel of the invention together with those of other steel samples for comparison.

TABLE 1

| Sample Steel No. | Chemical Composition (wt %) | | | | | | | | | | |
|---|---|---|---|---|---|---|---|---|---|---|---|
| | C | Si | Mn | P | S | sol.Al | N | Ti | Nb | Nb/C | Remarks |
| 1 | 0.004 | 0.010 | 0.15 | 0.015 | 0.008 | 0.042 | 0.0042 | 0.012 | 0.020 | 5.0 | The invention |
| 2 | 0.006 | 0.021 | 0.14 | 0.011 | 0.009 | 0.048 | 0.0057 | 0.021 | 0.015 | 2.5 | The invention |
| 3 | 0.004 | 0.019 | 0.30 | 0.020 | 0.005 | 0.051 | 0.0064 | 0.022 | 0.010 | 2.5 | The invention |
| 4 | 0.004 | 0.010 | 0.26 | 0.014 | 0.010 | 0.045 | 0.0050 | — | 0.020 | 5.0 | Comparison |
| 5 | 0.005 | 0.024 | 0.11 | 0.017 | 0.007 | 0.048 | 0.0041 | — | 0.042 | 8.04 | Comparison |
| 6 | 0.004 | 0.018 | 0.21 | 0.018 | 0.007 | 0.052 | 0.0053 | 0.075 | — | 8.06* | Comparison |
| 7 | 0.005 | 0.011 | 0.30 | 0.013 | 0.008 | 0.049 | 0.0047 | 0.025 | — | 2.58* | Comparison |
| 8 | 0.004 | 0.015 | 0.26 | 0.012 | 0.012 | 0.035 | 0.0070 | 0.022 | 0.030 | 6.0 | Comparison |

*Ti(%)/[C(%) + N(%)]

Figure 3:
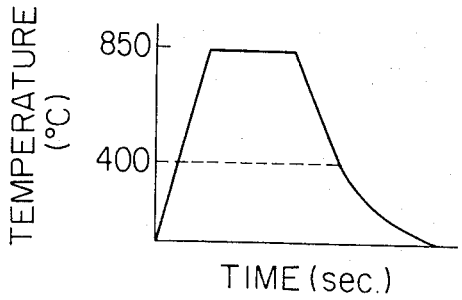
FIG. 3 is a graphic view explaining an annealing cycle.

Sample steels listed in Table 1 were hot rolled to 4.0 mm thick at the finish hot rolling temperature of 910° C., treated at two levels, namely, coiling temperature 720° and 620° C., respectively, then cold rolled to 0.8 mm thick, and thereafter subjected to the continuous anneal through the continuous anneal line with the annealing cycle as shown in FIG. 3. Namely, the steels were held at 800°–850° C. for a period of 30 seconds, and cooled to about 400° C. at a cooling rate 5°–100° C. per second.

The results of quality test conducted on the cold rolled steel sheet thus obtained are shown in Table 2.

Tables 2-(1a) and 2-(1b) refer to the steels subjected to the coiling temperature 720° C. while, Tables 2-(2a) and 2-(2b) to the steels treated at the coiling temperature 620° C.

TABLE 2

| Sample Steel No. | Mechanical Property | | | | | | | | | | Chemical* treating ability | Remarks |
|---|---|---|---|---|---|---|---|---|---|---|---|---|
| | YP (Kg/mm²) | TS (Kg/mm²) | El (%) | YP-El (%) | n | $r_L$ | $r_{45°}$ | $r_c$ | $\bar{r}$ | $\Delta r$ | | |

TABLE 2-continued

| Sample Steel No. | Mechanical Property | | | | | | | | | | Chemical* treating ability | Remarks |
|---|---|---|---|---|---|---|---|---|---|---|---|---|
| (1a) | Center in the longitudinal direction of coil | | | | | | | | | | | |
| 1 | 16.1 | 30.4 | 47.5 | 0.0 | 0.29 | 2.00 | 1.92 | 1.86 | 1.93 | 0.01 | O | The invention |
| 2 | 16.4 | 31.0 | 48.1 | 0.0 | 0.30 | 1.94 | 2.00 | 1.85 | 1.95 | −0.11 | O | The invention |
| 3 | 17.0 | 31.8 | 47.0 | 0.0 | 0.29 | 2.10 | 1.91 | 1.86 | 1.95 | 0.07 | O | The invention |
| 4 | 16.3 | 31.5 | 46.8 | 0.0 | 0.29 | 2.00 | 1.75 | 2.25 | 1.94 | 0.38 | O | Comparison |
| 5 | 16.1 | 31.1 | 46.7 | 0.0 | 0.28 | 1.97 | 1.70 | 2.30 | 1.92 | 0.44 | Δ-x | Comparison |
| 6 | 15.0 | 30.6 | 48.3 | 0.0 | 0.29 | 1.34 | 2.14 | 2.13 | 1.94 | −0.41 | x | Comparison |
| 7 | 18.0 | 32.2 | 46.5 | 0.2 | 0.26 | 1.85 | 1.15 | 2.05 | 1.55 | 0.80 | O | Comparison |
| 8 | 17.0 | 32.5 | 45.0 | 0.0 | 0.28 | 1.97 | 2.07 | 1.75 | 1.97 | −0.21 | x | Comparison |
| (2b) | Average of leading and trailing portions of coil | | | | | | | | | | | |
| 1 | 16.6 | 30.9 | 46.8 | 0.01 | 0.29 | 1.89 | 1.85 | 1.88 | 1.87 | 0.07 | | The invention |
| 2 | 17.0 | 31.5 | 47.9 | 0.01 | 0.29 | 1.88 | 1.92 | 1.83 | 1.89 | −0.07 | | The invention |
| 3 | 17.1 | 31.9 | 46.6 | 0.0 | 0.29 | 1.90 | 1.88 | 1.80 | 1.87 | −0.03 | | The invention |
| 4 | 24.0 | 36.0 | 37.4 | 0.10 | 0.25 | 1.30 | 1.32 | 1.66 | 1.40 | 0.16 | | Comparison |
| 5 | 24.9 | 36.1 | 37.2 | 0.11 | 0.23 | 1.29 | 1.31 | 1.66 | 1.39 | 0.17 | | Comparison |
| 6 | 15.0 | 31.0 | 48.1 | 0.0 | 0.29 | 1.30 | 2.01 | 2.09 | 1.85 | −0.31 | | Comparison |
| 7 | 20.7 | 33.7 | 44.0 | 0.6 | 0.23 | 1.42 | 1.02 | 1.65 | 1.28 | 0.52 | | Comparison |
| 8 | 20.8 | 33.1 | 43.2 | 0.0 | 0.24 | 1.58 | 1.60 | 1.28 | 1.52 | −0.17 | | Comparison |
| | YP (Kg/mm²) | TS (Kg/mm²) | El (%) | A.I. | n | $r_L$ | $r_{45°}$ | $r_c$ | $\bar{r}$ | Δr | | |
| (1b) | Average of leading and trailing portions of coil | | | | | | | | | | | |
| 1 | 16.7 | 30.8 | 47.0 | 0.0 | 0.29 | 1.90 | 1.85 | 1.88 | 1.87 | 0.04 | O | The invention |
| 2 | 16.6 | 31.8 | 47.5 | 0.0 | 0.28 | 1.83 | 1.98 | 1.84 | 1.91 | −0.15 | O | The invention |
| 3 | 17.5 | 32.4 | 46.3 | 0.0 | 0.28 | 1.89 | 1.95 | 1.84 | 1.91 | −0.09 | O | The invention |
| 4 | 23.5 | 35.1 | 38.6 | 0.0 | 0.24 | 1.60 | 1.34 | 1.83 | 1.53 | 0.38 | O | Comparison |
| 5 | 24.0 | 35.3 | 38.1 | 0.0 | 0.23 | 1.50 | 1.30 | 1.89 | 1.50 | 0.40 | Δ-x | Comparison |
| 6 | 15.2 | 30.6 | 48.2 | 0.0 | 0.28 | 1.31 | 2.10 | 2.13 | 1.91 | −0.38 | x | Comparison |
| 7 | 20.5 | 33.5 | 44.3 | 0.5 | 0.25 | 1.50 | 1.05 | 1.76 | 1.34 | 0.58 | O | Comparison |
| 8 | 19.7 | 32.7 | 43.0 | 0.0 | 0.24 | 1.56 | 1.68 | 1.38 | 1.58 | −0.21 | x | Comparison |
| (2a) | Center in the longitudinal direction of coil | | | | | | | | | | | |
| 1 | 16.5 | 30.8 | 47.0 | 0.01 | 0.28 | 1.90 | 1.86 | 1.87 | 1.87 | 0.03 | | The invention |
| 2 | 17.0 | 31.4 | 47.8 | 0.0 | 0.30 | 1.89 | 1.94 | 1.84 | 1.90 | −0.08 | | The invention |
| 3 | 17.2 | 31.9 | 46.8 | 0.0 | 0.29 | 1.86 | 1.90 | 1.80 | 1.87 | −0.07 | | The invention |
| 4 | 22.6 | 35.0 | 38.1 | 0.07 | 0.25 | 1.30 | 1.34 | 1.65 | 1.41 | 0.14 | | Comparison |
| 5 | 23.1 | 35.6 | 38.0 | 0.08 | 0.24 | 1.34 | 1.36 | 1.70 | 1.44 | 0.16 | | Comparison |
| 6 | 15.1 | 30.9 | 48.2 | 0.0 | 0.29 | 1.31 | 2.03 | 2.11 | 1.87 | −0.32 | | Comparison |
| 7 | 21.0 | 34.0 | 44.0 | 0.4 | 0.23 | 1.40 | 1.05 | 1.62 | 1.28 | 0.46 | | Comparison |
| 8 | 19.5 | 32.4 | 44.0 | 0.0 | 0.24 | 1.60 | 1.72 | 1.42 | 1.62 | −0.21 | | Comparison |

*Test procedure and Evaluation (1) Phosphate treatment used an immersion type chemical of phosphophylite, $Zn_2Fe(PO_4)_2$. Grs-D-2000 of Nippon Paint Co., Ltd. was used; sample steel was immersed in a bath of adjusted Ta16-18, AR18-20, $Zn^{++}$1000 ± 200 ppm, $Fe^{++}$ 50-100 ppm for a period of 120 seconds. But the surface of the sample steel was polished by a grinder and used.

(2) Evaluation was conducted in the following manner: the sample was photographed by a scanning electron microscope to a photograph of 1000 times magnification, and the density and size of phosphate crystal were determined. (O refers to good; Δ to one in which a part of the steel sheet (less than 50%) was defective; and x refers to one in which an area of more than 50% of the steel sheet was defective).

Note:

(1) A.I.: Ageing Index A.I. $= \frac{\sigma_B - \sigma_A}{\sigma_A}$ $\sigma_A$: Stress at the time of tensile prestrain 7.5-8%

$\sigma_B$: Yield strength when aging 100° C. × 1 hour was treated after prestrain 7.5-8%

Figure 4:
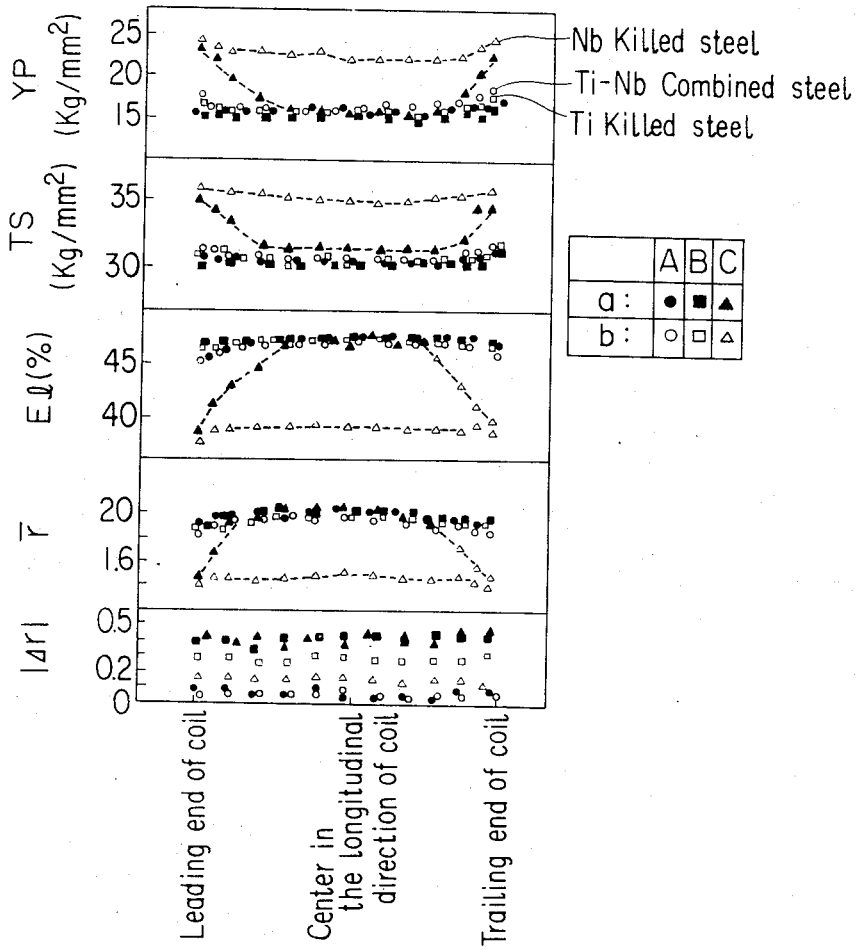
FIG. 4 is a graphic view explaining the distribution of a test value of the quality in the longitudinal direction of the coil.

(2) $\bar{r} = \frac{1}{4}(r_L + 2r_{45°} + r_c)$ (3) $\Delta r = \frac{1}{2}(r_L + r_c) - r_{45°}$ FIG. 4 shows the summary of distribution of mechanical properties in the longitudinal direction of the coil of sample steels. In FIG. 4, A refers to the steel with added Ti and Nb in combination, sample steel 2; B to the Ti killed steel 6; C to the Nb killed steel 4; "a" to the coiling temperature 720° C.; and "b" to the coiling temperature 620° C.

It is clear from Table 2 and FIG. 4 that the steel with added Ti and Nb of the invention has a distinguished quality as compared with the Ti or Nb killed steels of the prior art.

The Nb killed steel has a very high temperature of recrystallization at the usual coiling temperature of 620° C., consequently its yield strength is high while, on the contrary, its elongation is low. In the Nb killed steel subjected to the coiling temperature 720° C., its quality at the end portions of the coil is near that of the usually coiled steel, because the cooling rate is large at the end portions of the coil. As a result, its yield is very low.

On the contrary, however, the Ti killed steel has a uniform excellent quality in the longitudinal direction of the coil, provided that Ti is sufficiently added to cause C and N to be precipitated. However, when the amount of Ti to be added is deficient in the precipitation of C and N, in other words, in case Ti/C+N (atomic ratio) <1 (7), its quality is exceedingly deteriorated.

On the other hand, however, the steel with added Ti and Nb together shows a uniform excellent quality, almost the same as that of the Ti killed steel added with an ample amount of Ti.

Figure 5:
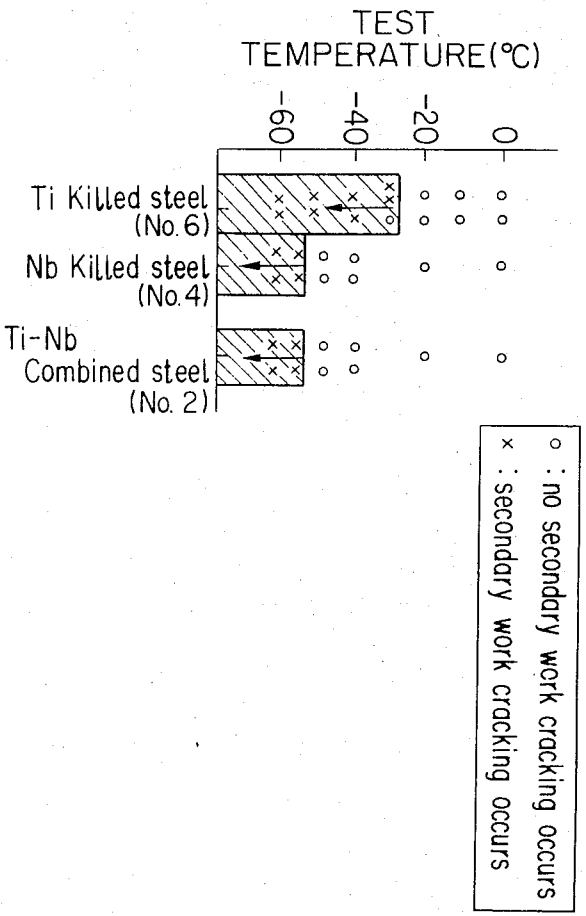
FIG. 5 is a graphic view explaining the temperature zone in which secondary work cracking takes place.

According to the test results of the secondary work cracking conducted on the sample steels with the drawing ratio of 3.0 as shown in FIG. 5, it has been clearly found that the Ti killed steel has a defect that the temperature range where cracking takes place is about 30° C. higher than that of the Nb killed steel, and also the steel with added Ti and Nb together. Conversely, the steel with added Ti and Nb together is on a good level, the same as that of the Nb killed steel.

However, in case the cooling rate is so slow as in the box anneal, the temperature range where embrittlement occurs is raised on account of the segregation of P in the grain boundary in the course of cooling, hence it is required for the steel of the invention to be produced by the continuous anneal. In addition, the anisotropy of the r value should be particularly emphasized.

As shown in FIG. 4, in the steel coiled at the usual temperature, Δr of any steel is so relatively small, but in the steel coiled at the high temperature, Δr of either Ti or Nb killed steel is considerably great.

Figure 6:
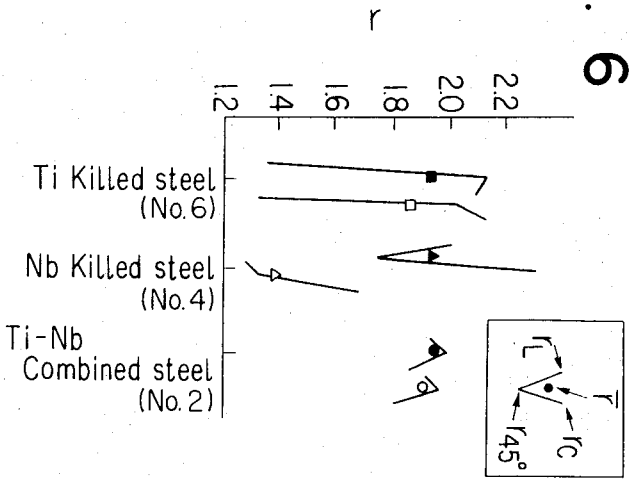
FIG. 6 is a graphic view explaining the r value and the anisotropy of the r value.

FIG. 6 shows the typical interfacial anisotropy of $\bar{r}$ value and r value of each steel; the $r_L$ or $r_{45°}$ of the Ti or Nb killed steels, respectively is very low, particularly, in the steel coiled at the high temperature, and the suitability of subjecting these steels to press forming for deep-drawing is highly open to question. On the other hand, in the steel with added Ti and Nb together, the $\bar{r}$ value of the steel coiled at the low temperature is not extremely low as the Nb killed steel, and the anisotropy is considerably small; and further, as compared with the $r_L$ and $r_C$, the $r_{45°}$ is almost equal thereto or a little larger. It exhibits particularly an eminent formability in forming a square cylindrical body.

Figure 7:
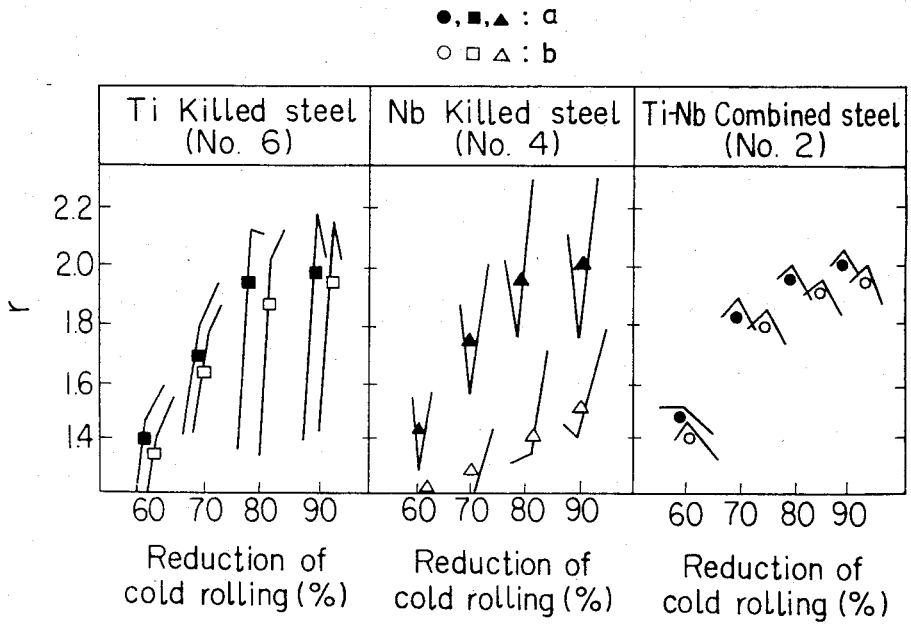
FIG. 7 is a graphic view explaining the dependence of the r value on the reduction of cold rolling.

FIG. 7 shows the behavior of the r value where the reduction of cold rolling was varied. In FIG. 7, a refers to the coiling temperature 720° C., while b to the coiling temperature 620° C.

As described hereinbefore, the anisotropy of the r value of the steel with added Ti and Nb together is noticeably low as compared with that of either Ti or Nb killed steel, and this characteristic is clearly perceived whether the reduction of cold rolling is large or small. Moreover, the steel with added Ti and Nb together has a relatively high r value even with a low reduction of cold rolling. Thus, it is a good useful steel from the practical processing aspect.

As shown in Table 2, the steel added with Ti and Nb together has an eminent work hardness coefficient, n value, and is non-ageing the same as the Ti or Nb killed steel.

According to the test results of chemical treating ability, it is seen that sample steels Nos. 5, 6 and 8 which exceed 0.04% (Nb + Ti) have inferior chemical treating ability, respectively. On the contrary, the steel of the invention has a good chemical treating ability.

EXAMPLE 2

Table 3 shows the chemical composition of the steel of the invention and other steels for comparison.

TABLE 3

| Sample Steel No. | Chemical Composition (wt %) C | Si | Mn | P | S | Sol.Al | N | Ti | Nb | Nb/C | Chemical treating ability*2 | Remarks |
|---|---|---|---|---|---|---|---|---|---|---|---|---|
| 9 | 0.004 | 0.025 | 0.15 | 0.065 | 0.004 | 0.047 | 0.0050 | 0.020 | 0.018 | 4.5 | O | The invention |
| 10 | 0.003 | 0.210 | 0.17 | 0.071 | 0.007 | 0.054 | 0.0037 | 0.015 | 0.012 | 4.0 | O | The invention |
| 11 | 0.005 | 0.206 | 0.17 | 0.072 | 0.005 | 0.050 | 0.0051 | — | 0.020 | 4.0 | O | Comparison |
| 12 | 0.005 | 0.180 | 0.16 | 0.070 | 0.007 | 0.040 | 0.0046 | 0.078 | — | 8.13*1 | x | Comparison |

*1 Ti(%)/[C(%) + N(%)]

*2 Test procedure and Evaluation are the same as Table 2 (1a) and Table (1b) and *.

Sample steels listed in Table 3 including the steel with added Ti and Nb of the present invention, Ti killed steel and Nb killed steel of the prior art, respectively, were mixed with an alloying element (chiefly, P) to give them high strength, respectively. The steels thus produced were hot rolled at the finish hot rolling temperature 910° C., coiled at 720° C. to them 4.00 mm, and then, they were cold rolled to 0.8 mm thick. Finally, they were annealed in the continuous anneal processing line with the anneal cycle shown in FIG. 3.

The test results of quality conducted on the above cold rolled steel sheet thus obtained are shown in Table 4.

TABLE 4

| Sample Steel No. | Mechanical Property YP (Kg/mm²) | TS (Kg/mm²) | El (%) | A.I. | n | $r_L$ | $r_{45°}$ | $r_C$ | $\bar{r}$ | Δr | Remarks |
|---|---|---|---|---|---|---|---|---|---|---|---|
| | Center in longitudinal direction of coil | | | | | | | | | | |
| 9 | 19.1 | 38.8 | 41.2 | 0.0 | 0.27 | 1.73 | 1.89 | 1.70 | 1.80 | −0.18 | The invention |
| 10 | 20.3 | 39.5 | 40.8 | 0.0 | 0.26 | 1.80 | 1.83 | 1.76 | 1.81 | −0.05 | The invention |
| 11 | 21.0 | 40.2 | 39.9 | 0.0 | 0.26 | 1.76 | 1.56 | 2.22 | 1.78 | 0.43 | Comparison |
| 12 | 18.8 | 38.5 | 41.0 | 0.0 | 0.26 | 0.91 | 1.84 | 1.85 | 1.61 | −0.46 | Comparison |
| | Average of leading and trailing portions of coil | | | | | | | | | | |
| 9 | 19.4 | 39.3 | 40.5 | 0.0 | 0.26 | 1.76 | 1.86 | 1.70 | 1.80 | −0.13 | The invention |
| 10 | 20.4 | 39.7 | 40.6 | 0.0 | 0.26 | 1.78 | 1.82 | 1.78 | 1.80 | −0.04 | The invention |
| 11 | 26.2 | 43.5 | 34.5 | 0.0 | 0.22 | 1.35 | 1.17 | 1.81 | 1.38 | 0.41 | Comparison |
| 12 | 19.0 | 38.9 | 40.5 | 0.0 | 0.25 | 0.99 | 1.83 | 1.75 | 1.60 | −0.46 | Comparison |

Figure 8:
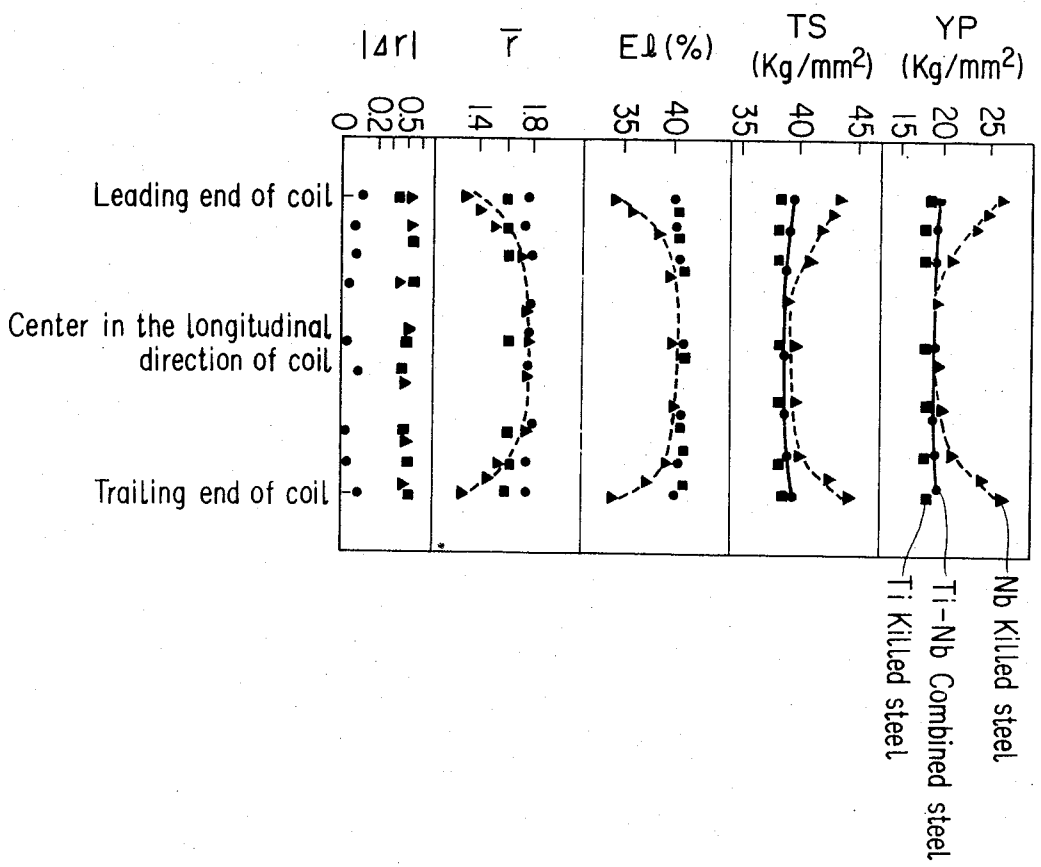
FIG. 8 is a graphic view explaining the distribution of test values of quality in the longitudinal direction of the coil.

FIG. 8 shows the distribution of quality characteristic values in the longitudinal direction of the coil of respective sample steels. In FIG. 8, the steel with added Ti and Nb refers to sample steels 9 and 10; the Ti killed steel to 12 and the Nb killed steel to 11. It is clear from Table 4 and FIG. 8 that the Ti killed steel with added P has a disadvantage that the r value is inferior on the order of about 0.2 to the steel with added Ti and Nb together and the Nb killed steel in the center of the coil. The Ti killed steel with added P has a tendency to raise the temperature where secondary work cracking occurs as shown in FIG. 5. Further, in the Nb killed steel, the deterioration of quality in the end portion of the coil is noticeable.

As compared with the above steels of the prior art, in the steel with added Ti and Nb, the level of the r value is equally high in the center of the longitudinal direction of the coil the same as the Nb killed steel, and the distribution f quality in the longitudinal direction of the coil is extremely uniform the same as the Ti killed steel.

In addition, the anisotropy of the r value of the steel of the invention is extremely small, which is a distinguished characteristic unobtainable in both Ti killed and Nb killed steels. Thus, it is clear that the steel of the invention has a distinguished superiority to any steel made high strength by adding an alloying element.

EXAMPLE 3

Figure 9:
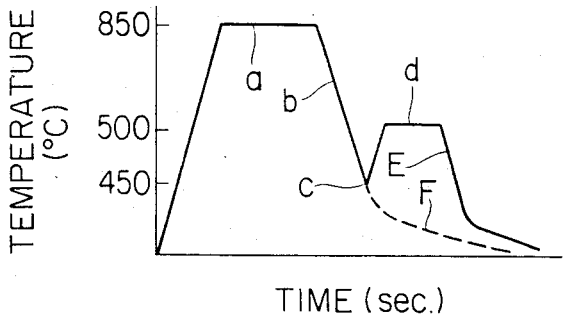
FIG. 9 is a graphic view explaining the annealing cycle.

Sample steels 2, 3, 5, 6, 9, 11 and 12 selected from those listed in Tables 1 and 3 were cold rolled under the same conditions as described in Example 2, and thereafter the molten zinc coated steel sheet was produced from them, respectively, with the anneal cycle as shown in FIG. 9 wherein the steels were held at a temperature of 800°-850° C. for a period of 30 seconds; (a) cooled to about 450° C. with a cooling rate of 3°-100° C./sec.; (b) treated in a molten zinc bath of 450°-500° C.; and (E) subjected to an alloying treatment (d) at about 500°-560° C. The cycle (F) refers to the case where the alloying treatment was not carried out while (E) to the case where the alloying treatment was carried out to produce the alloyed zinc coated steel sheet. The mechanical properties of the zinc coated steel sheet were hardly affected by the operation whether the alloying treatment was carried out or not. Tables 5a, 5b show the quality characteristic value of the zinc coated steel sheet wherein the alloying treatment (E) was carried out.

TABLE 5

| Sample Steel No. | Mechanical Property YP (Kg/mm²) | TS (Kg/mm²) | El (%) | A.I. | n | $r_L$ | $r_{45°}$ | $r_c$ | $\bar{r}$ | Δr | Remarks |
|---|---|---|---|---|---|---|---|---|---|---|---|
| | Center in the longitudinal direction of coil | | | | | | | | | | |
| 2 | 16.9 | 31.4 | 47.9 | 0.0 | 0.30 | 1.99 | 1.91 | 1.85 | 1.92 | 0.01 | The invention |
| 3 | 17.1 | 32.0 | 46.6 | 0.0 | 0.29 | 2.05 | 1.89 | 1.87 | 1.93 | 0.07 | The invention |
| 5 | 16.7 | 31.7 | 46.3 | 0.0 | 0.28 | 1.94 | 1.67 | 2.36 | 1.91 | 0.48 | Comparison |
| 6 | 15.3 | 30.7 | 47.9 | 0.0 | 0.29 | 1.30 | 2.11 | 2.09 | 1.90 | −0.42 | Comparison |
| 9 | 19.5 | 39.1 | 40.7 | 0.0 | 0.27 | 1.70 | 1.88 | 1.71 | 1.79 | −0.18 | The invention |
| 11 | 21.5 | 40.6 | 39.8 | 0.0 | 0.26 | 1.73 | 1.52 | 2.17 | 1.74 | 0.43 | Comparison |
| 12 | 18.7 | 38.4 | 40.5 | 0.0 | 0.26 | 0.88 | 1.80 | 1.81 | 1.57 | −0.46 | Comparison |
| | Average of leading and trailing portions of coil | | | | | | | | | | |
| 2 | 16.9 | 31.5 | 46.9 | 0.0 | 0.29 | 1.90 | 1.85 | 1.88 | 1.87 | 0.04 | The invention |
| 3 | 17.8 | 32.7 | 46.0 | 0.0 | 0.27 | 1.87 | 1.93 | 1.82 | 1.89 | −0.09 | The invention |
| 5 | 24.9 | 35.8 | 37.6 | 0.10 | 0.23 | 1.46 | 1.36 | 1.86 | 1.51 | 0.30 | Comparison |
| 6 | 15.6 | 30.8 | 48.1 | 0.0 | 0.28 | 1.28 | 2.07 | 2.11 | 1.88 | 0.38 | Comparison |
| 9 | 19.7 | 39.8 | 40.3 | 0.0 | 0.26 | 1.75 | 1.88 | 1.69 | 1.80 | 0.03 | The invention |
| 11 | 26.6 | 44.0 | 34.0 | 0.11 | 0.21 | 1.31 | 1.13 | 1.75 | 1.33 | 0.40 | Comparison |
| 12 | 19.1 | 39.0 | 40.3 | 0.0 | 0.24 | 0.96 | 1.79 | 1.71 | 1.56 | −0.38 | Comparison |

The quality and characteristic properties of each sample steel shown almost the same tendency as those obtained in Examples 1 and 2. Therefore the steel of the invention is extremely excellent as a molten zinc coated steel sheet. In the steel sheet coated with the alloyed zinc coating layer, if the alloying reaction proceeds too excessively, a brittle alloyed layer grows so much that there arises a danger which causes powdering when the coated sheet is subjected to the press forming work.

Table 6 shows the test results of powdering in which 10 coils were produced from each steel, 10 samples were taken from them, namely, 100 samples in all were collected, and the powdering test was conducted on each sample.

TABLE 6

| Sample Steel | 2 | 3 | 5 | 6 | 9 | 11 | 12 |
|---|---|---|---|---|---|---|---|
| Rate of Occurrence of of Powdering | 2 $\left(\frac{2}{100}\right)$ | 3 $\left(\frac{2}{100}\right)$ | 5 $\left(\frac{1}{100}\right)$ | 6 $\left(\frac{31}{100}\right)$ | 9 $\left(\frac{1}{100}\right)$ | 11 $\left(\frac{0}{100}\right)$ | 12 $\left(\frac{22}{100}\right)$ |
| Remarks | The invention | The invention | Comparison | Comparison | The invention | Comparison | Comparison |

In the Ti killed steel, the rate of occurrence of powdering is very high, because Ti promotes the alloying reaction of iron base with molten zinc to accelerate a super-alloying reaction. The steel with added Ti and Nb of this invention is almost on the same level as the Nb killed steel, and has a very good resistance to powdering. In this respect, the steel of the invention is a most suitable stock for a good alloyed zinc coated steel sheet.

EXAMPLE 4

A steel slab having the chemical composition shown in Table 7 was produced, and the slab was hot rolled under the hot rolling requirement indicated in Table 7. The finish hot rolling temperature was in the range of 890°-910° C., respectively. The hot rolled steel sheet was 3.8 mm thick, then after pickling it was cold rolled to 0.8 mm thick, and thereafter the cold rolled steel sheet was annealed in a continuous anneal furnace. The anneal cycle was about 10° C./sec., the steel was heated to 780°-820° C., held at this temperature range for a period of 40 seconds, and then cooled to the room temperature at an average cooling rate 50°-100° C./sec. The steel was subjected to 0.8% skin pass rolling, and thereafter the quality test was conducted on every steel sheet. The test results including the chemical treating ability and secondary work cracking are shown in Table 8.

The steel of the present invention (refers to Nos. 1-3) shows good results, respectively. Sample steel No. 4 was not mixed with B, so the secondary work cracking tends to occur while, conversely, No. 5 was mixed with too much $B_1$ hence the values of YP, El, and r were not satisfactory, respectively.

TABLE 7

| Sample Steel No. | Chemical Composition (wt. %) C (ppm) | Si | Mn | P | S | Al | N (ppm) | B (ppm) | Nb | Ti | Hot Rolling Requirement Heat. Temp. (°C.) | Coil. Temp. (°C.) |
|---|---|---|---|---|---|---|---|---|---|---|---|---|
| 1 | 31 | 0.01 | 0.15 | 0.015 | 0.01 | 0.050 | 36 | 3 | 0.015 | 0.005 | 1250 | 680 |
| 2 | 48 | 0.01 | 0.18 | 0.010 | 0.01 | 0.045 | 40 | 15 | 0.020 | 0.018 | 1200 | 700 |
| 3 | 48 | 0.02 | 0.17 | 0.017 | 0.01 | 0.041 | 47 | 10 | 0.020 | 0.014 | 1210 | 710 |
| 4 | 40 | 0.01 | 0.16 | 0.011 | 0.01 | 0.048 | 38 | — | 0.015 | 0.015 | 1250 | 680 |
| 5 | 41 | 0.01 | 0.15 | 0.014 | 0.02 | 0.045 | 35 | 37 | 0.016 | 0.012 | 1250 | 680 |

TABLE 8

| Sample Steel No. | YP (Kgf/mm²) | TS (Kgf/mm²) | El (%) | $\bar{r}$ value | n value | Yield point elongation (%) (after aging 100° C. × 1 hr.) | Secondary* workability | Chemical** treating ability |
|---|---|---|---|---|---|---|---|---|
| 1 | 15.7 | 31.5 | 50.0 | 2.10 | 0.25 | 0.0 | 3.9 | O |
| 2 | 15.0 | 30.5 | 52.1 | 2.20 | 0.27 | 0.0 | 3.9 | O |
| 3 | 15.2 | 30.7 | 52.2 | 2.28 | 0.27 | 0.0 | 3.9 | O |
| 4 | 16.2 | 31.8 | 50.0 | 2.00 | 0.25 | 0.0 | 2.5 | O |
| 5 | 18.5 | 33.1 | 47.5 | 1.76 | 0.24 | 0.0 | 3.7 | O |

Note:
*Cracking test was conducted at −70° C. Deformation rate 200 mm/min. Values were shown as the largest drawing ratio where no cracking occurred.
**Test procedure and evaluation are the same as shown in Table 2 (1a) and Table 2 (1b).

EXAMPLE 5

Sample steels containing a very low carbon listed in Table 9 were subjected to the continuous casting process to form a slab casting process, respectively, but sample steel No 7 was mixed with Nb while No. 6 with Ti only. Steels Nos. 6–7 were for comparison In hot rolling, the surface heating temperature was 1150° C., its finish temperature in the range of 740° C.–860° C., and the steel was coiled at 650° C. The hot rolled steel sheet 3.2 mm thick was pickled, then cold rolled to a sheet 0.8 mm thick, and thereafter subjected to recrystallization anneal in the continuous anneal furnace at 830° C. for a period of 35 seconds. The 0.8% skin pass rolling was conducted on the steel sheet, and thereafter the quality and chemical treating ability thereof were determined to obtain the test results as shown in Table 10.

Comparative steel No. 5 contained Nb +Ti =0.048 wt % to show its inferior result in the chemical treating ability; and its Nb content was too high, so its yield point was high and its elongation was low. Comparative steel No. 6 was mixed with Ti in an amount of less than the equivalent of (C +N), and it was deficient in ductility and somewhat hard, and the r value was unsatisfactory; particularly, the r value in the 45° direction was deficient. Comparative steel No. 7 was mixed with Nb, and it was found that the r value was sufficiently high while, on the other hand, its ductility was inferior and hard; and satisfactory quality was not attained by the low temperature coiling process.

TABLE 9

| Sample Steel No. | Chemical Composition (wt %) C | Si | Mn | P | S | Sol. Al | N | Ti | Nb | Slab Heating Temp. (°C.) | Finish Temp. (°C.) | Coiling Temp. (°C.) |
|---|---|---|---|---|---|---|---|---|---|---|---|---|
| 1 | 0.0030 | 0.019 | 0.23 | 0.012 | 0.010 | 0.035 | 0.0025 | 0.012 | 0.007 | 1150 | 740 | 650 |
| 2 | 0.0040 | 0.02 | 0.18 | 0.013 | 0.005 | 0.045 | 0.0035 | 0.010 | 0.015 | 1150 | 860 | 650 |
| 3 | 0.0025 | 0.032 | 0.15 | 0.015 | 0.006 | 0.058 | 0.0052 | 0.013 | 0.010 | 1150 | 800 | 650 |
| 4 | 0.005 | 0.030 | 0.25 | 0.018 | 0.005 | 0.042 | 0.0042 | 0.014 | 0.022 | 1150 | 780 | 650 |
| 5 | 0.004 | 0.02 | 0.28 | 0.017 | 0.007 | 0.048 | 0.0047 | 0.020 | 0.028 | 1150 | 860 | 650 |
| 6 | 0.003 | 0.05 | 0.21 | 0.015 | 0.008 | 0.048 | 0.0052 | 0.025 | — | 1150 | 840 | 650 |
| 7 | 0.003 | 0.02 | 0.17 | 0.014 | 0.008 | 0.055 | 0.0035 | — | 0.020 | 1150 | 840 | 650 |

TABLE 10

| Sample Steel No. | YP (Kg/mm²) | TS (Kg/mm²) | El (%) | r value | YP-El (%) after ageing 100° C. × 1 hr. | Chemical* Treating Ability | Remarks |
|---|---|---|---|---|---|---|---|
| 1 | 17 | 32 | 47 | 1.83 | 0 | O | The invention |
| 2 | 17 | 32 | 48 | 1.95 | 0 | O | The invention |
| 3 | 18 | 32 | 48 | 1.85 | 0 | O | The invention |
| 4 | 18 | 32 | 46 | 1.89 | 0 | O | The invention |
| 5 | 20 | 33 | 44 | 1.75 | 0 | Δ | Comparison |
| 6 | 21 | 33 | 42 | 1.50 | 0.5 | O | Comparison |
| 7 | 22 | 34 | 42 | 1.72 | 0.2 | O | Comparison |

Note:
*Test Procedure and Evaluation are the same as shown in Table 2 (1a) and Table 2 (1b).

EXAMPLE 6

Steel having the composition consisting of 0.003% C, 0.025% Si, 0.23% Mn, 0.015% P, 0.008% S, 0.045% sol.Al, 0.0045% N, 0.012% Ti and 0.012% Nb (percentage being by weight) was subjected to the continuous casting process to produce many slabs; and these slabs were subjected to hot rolling at the slab heating temperature and at the finish hot rolling temperature as shown in Table 11 to produce hot rolled coil 3.0 mm thick, and finally the coil was obtained at a temperature in the range of 620°-650° C. by coiling itself.

After pickling, the coil was cold rolled to produce a cold rolled steel sheet 0.8 mm thick, and then the steel sheet was annealed in the continuous anneal process at 780° C. for a period of 35 seconds for recrystallization anneal. After the 0.8% skin pass rolling, its quality and chemical treating ability were determined to obtain the results as shown in Table 11.

In sample steels Nos. 6 and 7 wherein the finish hot rolling was completed at 910° C., (Nb·Ti)C was not fully precipitated in the hot rolled sheet so that it was hard and had an inferior ductility, and the r value was not satisfactory. Sample steel No. 5 had a somewhat inferior quality on account of the high heating temperature. As regards sample steels Nos. 1-4, the slabs were heated at a low temperature, hence the useful effect of the present invention was sufficiently exhibited so that excellent results were obtained.

TABLE 11

| Sample Steel No. | Slab Surface Heat. Temp. (°C.) | PROPERTY Finish Temp. (°C.) | YP (Kg/mm²) | TS (Kg/mm²) | El (%) | r value | YP-El (%) after aging 100° C. × 1 hr | Chemical* Treating Ability |
|---|---|---|---|---|---|---|---|---|
| 1 | 1050 | 720 | 15 | 31 | 50 | 1.9 | 0 | O |
| 2 | " | 800 | 15 | 31 | 51 | 2.1 | 0 | O |
| 3 | " | 850 | 15 | 31 | 51 | 2.1 | 0 | O |
| 4 | 980 | 800 | 14 | 30 | 52 | 2.2 | 0 | O |
| 5 | 1250 | 800 | 18 | 33 | 46 | 1.78 | 0.1 | O |
| 6 | 1250 | 910 | 20 | 33 | 45 | 1.70 | 0.2 | O |
| 7 | 1150 | 910 | 19 | 33 | 46 | 1.77 | 0.1 | O |

Note:
*Test Procedure and Evaluation are the same as shown in Tables 2 (1a) and 2 (1b).

What is claimed is:

1. A method for producing a deep drawable steel sheet, which comprises:

providing a steel containing, in weight %, less than 0.007% C, less than 0.8% Si, less than 1.0% Mn, less than 0.1% P, 0.01-0.1% Al, less than 80 ppm N, Ti in an amount which satisfies the relationship 48/14(N %−0.002%)<Ti %<(48/12C %+48/14N %), Nb in an amount of at least 0.003% but less than 0.025% and which satisfies the relationship Nb %>2.33C %, the total amount of Nb and Ti being such that Nb+Ti<0.04%, and optionally B in solid solution, the remainder being Fe and unavoidable impurities;

hot rolling said steel while causing all of said N in said steel to become fixed as TiN;

cold rolling said hot rolled steel; and subjecting said cold rolled steel to a continuous anneal at a temperature of more than 700° C. but less than the $Ac_3$ transformation point.

2. A method as claimed in claim 1 in which said steel is subjected to finish hot rolling at a temperature of 720° C.-870° C., and said hot rolled steel sheet is coiled at a temperature of less than 680° C.

3. A method as claimed in claim 2 which said steel in the form of a slab is subjected to said hot rolling, and the heating temperature of the slab before said hot rolling is in the range of 950°-1170° C.

4. A method as claimed in claim 1 in which the total amount of Nb and Ti is in the range of 0.01%<Nb %+Ti %<0.04%.

5. A method as claimed in claim 4 in which said steel contains 2 ppm-10 ppm B.

6. A method as claimed in claim 1 in which said steel contains less than 30 ppm B, and said B exists in solid solution in said steel.

7. A method as claimed in claim 6 in which said steel is subjected to finish hot rolling at a temperature of 720° C.-870° C., and said hot rolled steel sheet is coiled at a temperature of less than 680° C.

8. A method as claimed in claim 4 in which said steel in the form of a slab is subjected to said hot rolling, and the heating temperature of the slab before said hot rolling is in the range of 950°-1170° C.

9. A method as claimed in claim 5 in which said steel in the form of a slab is subjected to said hot rolling, and the heating temperature of the slab before said hot rolling is in the range of 950°-1170° C.

10. A method as claimed in claim 6 in which said steel in the form of a slab is subjected to said hot rolling, and the heating temperature of the slab before said hot rolling is in the range of 950°-1170° C.

11. A method as claimed in claim 5 in which said steel is subjected to finish hot rolling at a temperature of 720° C.-870° C., and said hot rolled steel sheet is coiled at a temperature of less than 680° C.

12. A method as claimed in claim 4 in which said steel contains less than 30 ppm B, and said B exists in solid solution in said steel.

13. A method as claimed in claim 4 in which said steel is subjected to finish hot rolling at a temperature of 720° C.-870° C., and said hot rolled steel sheet is coiled at a temperature of less than 680° C.

* * * * *